US006866011B1

(12) United States Patent
Beardmore

(10) Patent No.: US 6,866,011 B1
(45) Date of Patent: Mar. 15, 2005

(54) BLOCK-MOUNTED PISTON SQUIRTER

(75) Inventor: John M. Beardmore, Howell, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/682,284

(22) Filed: Oct. 9, 2003

(51) Int. Cl.[7] ..... F01P 1/04
(52) U.S. Cl. ..... 123/41.35
(58) Field of Search ..... 123/41.35

(56) References Cited

U.S. PATENT DOCUMENTS 1,612,372 A * 12/1926 Gussman ..... 184/6.5
4,715,335 A * 12/1987 Elsbett et al. ..... 123/41.35
5,946,790 A 9/1999 Graham et al. ..... 29/564
6,019,071 A 2/2000 Maciejka, Jr. ..... 123/41.35

FOREIGN PATENT DOCUMENTS

FR 2745329 A1 * 8/1997 ..... F01M/1/08
JP 7-243313 A * 9/1995 ..... F01M/1/08
JP P2003 83019 A * 3/2003 ..... F01M/1/08

* cited by examiner

*Primary Examiner*—Noah Kamen
(74) *Attorney, Agent, or Firm*—Karl F. Barr, Jr.

(57) ABSTRACT

An internal combustion engine for a vehicle includes an engine block having a piston moveable within a cylinder bore. The piston has a piston skirt and a dome. A connecting rod operatively connects the piston to a crankshaft. A squirter is connected to the engine block and has a nozzle aimed to spray lubricant against a wall of the cylinder bore slightly below the piston skirt when the piston is at top dead center.

19 Claims, 4 Drawing Sheets

BLOCK-MOUNTED PISTON SQUIRTER

TECHNICAL FIELD

The present invention relates to a block-mounted piston squirter which is angled to spray against a wall of a cylinder bore slightly below a piston skirt when the piston is at top dead center, and to spray the piston during the rest of the stroke for cooling and lubrication.

BACKGROUND OF THE INVENTION

In recent years, piston noise complaints have been on the rise. Piston noise includes "piston slap" and wrist pin knock or rattle. These noises are most frequently generated upon cold starting of the engine, but can also be manifest on hot restarts. Objection to piston noise continues to be a source of customer complaints. Even though normal piston noise is not indicative of eminent mechanical failure, customers may deem it as unacceptable and the engine as lacking quality.

Modern piston noise can be attributed to lateral instability of the piston assembly and lack of sufficient lubrication within the critical interfaces of the piston-to-bore and wrist pin joints. Severe packaging constraints and ever increasing power demands have led to very short piston designs with rotund skirt profiles. Furthermore, a challenging high temperature environment now exists for the piston and pin, which requires some means for supplemental cooling. In the past, the automotive piston/pin assembly has relied primarily on "splash" lubrication for cooling and noise control. However, relatively dry cylinder bores and pin joints have resulted for a number of reasons. Most notable of these contributors are tight crank bearing clearances (for low crank system noise) and aggressive piston ring designs (for reduced oil consumption). Unfortunately, these necessary refinements exacerbate the dry scenario for the reciprocating hardware. This is especially the case upon engine start up, as immediate lubrication is critical for "cushioning" the relevant interfaces involved with piston noise.

The advent of polymer coated piston skirts has enabled much tighter piston fit tolerances, which has addressed the aspect of piston stability with a remarkable reduction in piston noise. However, pin noise remains and piston noises can still be of concern in certain instances. Therefore, additional lubrication has become a fundamental requirement for the contemporary high performance engine. The most viable means of supplying added lube to the reciprocating hardware include rifle drilled rods, connecting rod squirters, and full time block-mounted piston oilers.

Rifle drilled rods are less frequently employed in automotive engines than block squirters. This design includes a passage drilled through the entire length of the rod's column, thus connecting the wrist pin end to the big end of the rod. Oil is fed up through the center of the rod and directed as necessary to facilitate pin lubrication and/or to cool the piston under-dome. This technology is often used in large HD diesel engines. Its main advantage is communicating lubricant directly and internally right to the point of use for maximum effectiveness. The largest deterrents to gun drilled rods is the cost associated with drilling such a long, small diameter passage. The scrap rate can be excessive in weight conscious designs.

The most popular means for supplying added lube to the reciprocating hardware is connecting rod squirters, which incorporate a small orifice along the side of the rod. Rod squirters emit an intermittent spirt of oil, once per engine revolution, whenever the squirter hole in the rod aligns with the drilled lube passage in the crank's rod journal. Properly timed and targeted, the rod squirter can provide ample lube for the piston squirt thrust surfaces as well as for the wrist pin joints. The main advantages of rod squirters are that they usually package better than block squirters and do not place a huge demand on the oil supply system (i.e., the oil pump). Additionally, rod squirters are generally less expensive than block squirters.

Full time block squirters consist of a nozzle that is mounted in the crankcase, near the bottom of each cylinder, which directs a steady stream of oil to the bottom side of the piston dome. To alleviate excessive demands on the oil pump, usually the nozzle head incorporates a check ball valve assembly. These check valves typically begin to flow when the supply pressure exceeds around 25 psi (175 kPa). The main benefit of block squirters is that of piston cooling, which can lower critical piston surface temperatures by 30° C. Disadvantages of common block squirters are that their targeting is much less effective for cold noise control, and they are difficult to package. Quite often, block squirters mandate that a notch be provided at the lower end of the piston squirt for clearance at bottom dead center. This is undesirable as it creates a stress riser in an area of the piston skirt, which is already under high stress. Further, block squirters are typically more expensive to implement and somewhat more likely to malfunction due to a plugged or sticky check valve.

All contemporary block-mounted squirters orient the discharge from the nozzle straight up the center of the bore such that the oil stream impinges on the underside of the piston dome for maximum cooling. The sprayed lubricant is in continuous contact with the underside of the dome for the entire stroke of the piston. This type of spray provides little, if any, lubrication to the piston skirt-to-bore interface. With the piston in the vicinity of top dead center, oil must be present within this interface immediately upon a cold start-up of the engine to minimize noise. With block-mounted squirters targeted straight up the center of the piston, the oil is disbursed but virtually all of it is contained within the piston's cavity. Essentially none of the oil is splashed onto the bore walls. This problem is exacerbated upon cold starts and under low engine speed conditions wherein traditionally targeted block squirters do not distribute oil high enough up on the cylinder walls nor when it is most needed for piston noise control.

SUMMARY OF THE INVENTION

The invention provides a block-mounted squirter with a nozzle which is angled to spray lubricant slightly below the piston skirt when the piston is at top dead center for lubricating the piston skirt-to-bore interface. The squirter also sprays lubricant on the piston interior and wrist pin areas.

More specifically, the invention provides an internal combustion engine for a vehicle, having an engine block with a piston movable within a cylinder bore. The piston has a piston skirt and a dome. A connecting rod operatively connects the piston to a crankshaft. A squirter is connected to the engine block and has a nozzle aimed to spray lubricant against a wall of the cylinder bore slightly below the piston skirt when the piston is at top dead center.

Preferably, the nozzle is aimed to spray the lubricant diagonally across the cylinder bore, and may be sprayed onto either thrust side of the cylinder bore. Also, the nozzle is preferably aimed to spray the lubricant between approximately 3 and 8 millimeters below the piston skirt when the piston is at top dead center.

The piston is connected to a connecting rod by a wrist pin, and the nozzle is aimed to spray on the wrist pin in the middle portion of each piston stroke. The nozzle also sprays lubricant on an underside of the piston dome during the majority of the piston stroke.

Preferably only one squirter is provided for each cylinder bore of the engine.

The squirter includes a spring loaded ball valve to assure that at least a minimum lubricant pressure, such as 25 to 30 psi, is maintained within the main oil gallery prior to squirting the lubricant through the nozzle.

A method is also provided for lubricating a piston reciprocating between top dead center and bottom dead center positions within a cylinder bore of an engine block, wherein the piston has a dome and a skirt. The method includes: a) spraying lubricant across the cylinder bore against a wall of the cylinder bore slightly below the skirt of the piston when the piston is at the top dead center position; b) spraying lubricant onto a wrist pin connecting the piston with a connecting rod when the piston is between the top dead center and bottom dead center positions; and c) spraying lubricant onto an underside of the dome when the piston is at the bottom dead center position.

The above features and advantages, and other features and advantages of the present invention are readily apparent from the following detailed description of the best mode for carrying out the invention when taken in connection with the accompanying drawings.

DESCRIPTION OF THE PREFERRED EMBODIMENTS

Figure 1:
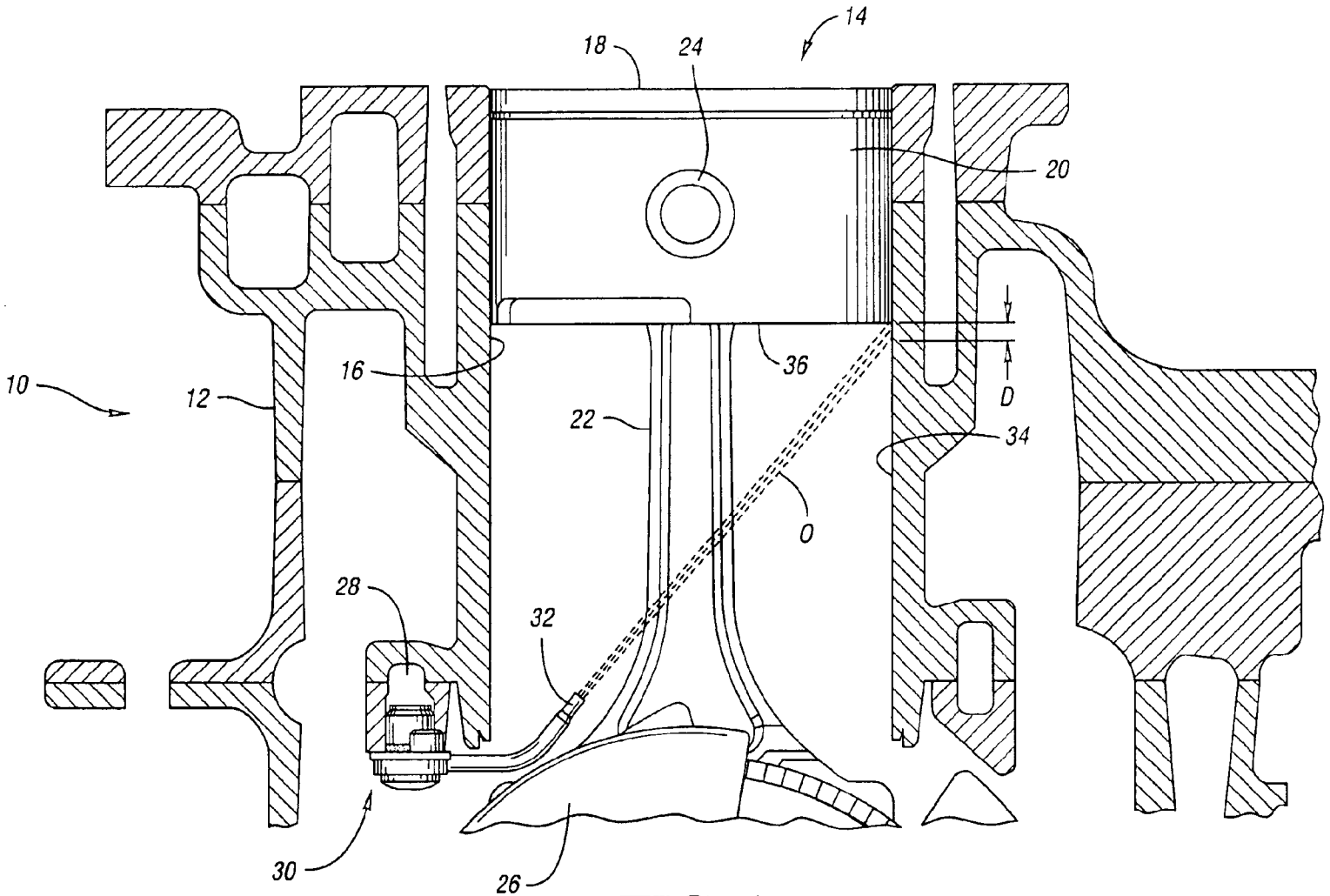
FIG. 1 shows a partial cutaway side view of an engine incorporating a block squirter in accordance with the invention, wherein the piston is at top dead center.

Referring to FIG. 1, an internal combustion engine 10 is shown including an engine block 12 with a piston 14 movable within a cylinder bore 16 between top dead center and bottom dead center positions. In FIG. 1, the piston 14 is shown in the top dead center position. The piston 14 includes a dome 18 and a skirt 20. A connecting rod 22 is operatively connected to the piston 14 by a wrist pin 24. The opposite end of the connecting rod 22 is connected with the crankshaft 26.

The engine block 12 includes a dedicated rail or gallery 28 which carries pressurized oil at the engine's "line pressure," which is the base operating pressure for the engine hydraulics. A block-mounted oil squirter 30 is connected to the engine block 12 in fluid communication with the rail 28 for receiving the pressurized oil in the rail and spraying the oil through the nozzle 32 across the cylinder bore 16 impinging against the wall 34 of the cylinder bore 16. The sprayed oil is indicated by reference O in FIG. 1. As shown, the oil is sprayed in a steady stream, and is targeted to a location on the cylinder wall 34 which is a distance D below the lower edge 36 of the piston skirt 20. The distance D is preferably approximately 3 to 8 millimeters, such that the sprayed oil hits the cylinder wall 34 between 3 and 8 millimeters below the lower edge 34 of the skirt 20 to provide sufficient lubrication of the piston skirt-to-cylinder bore interface to reduce piston noise.

Figure 2:
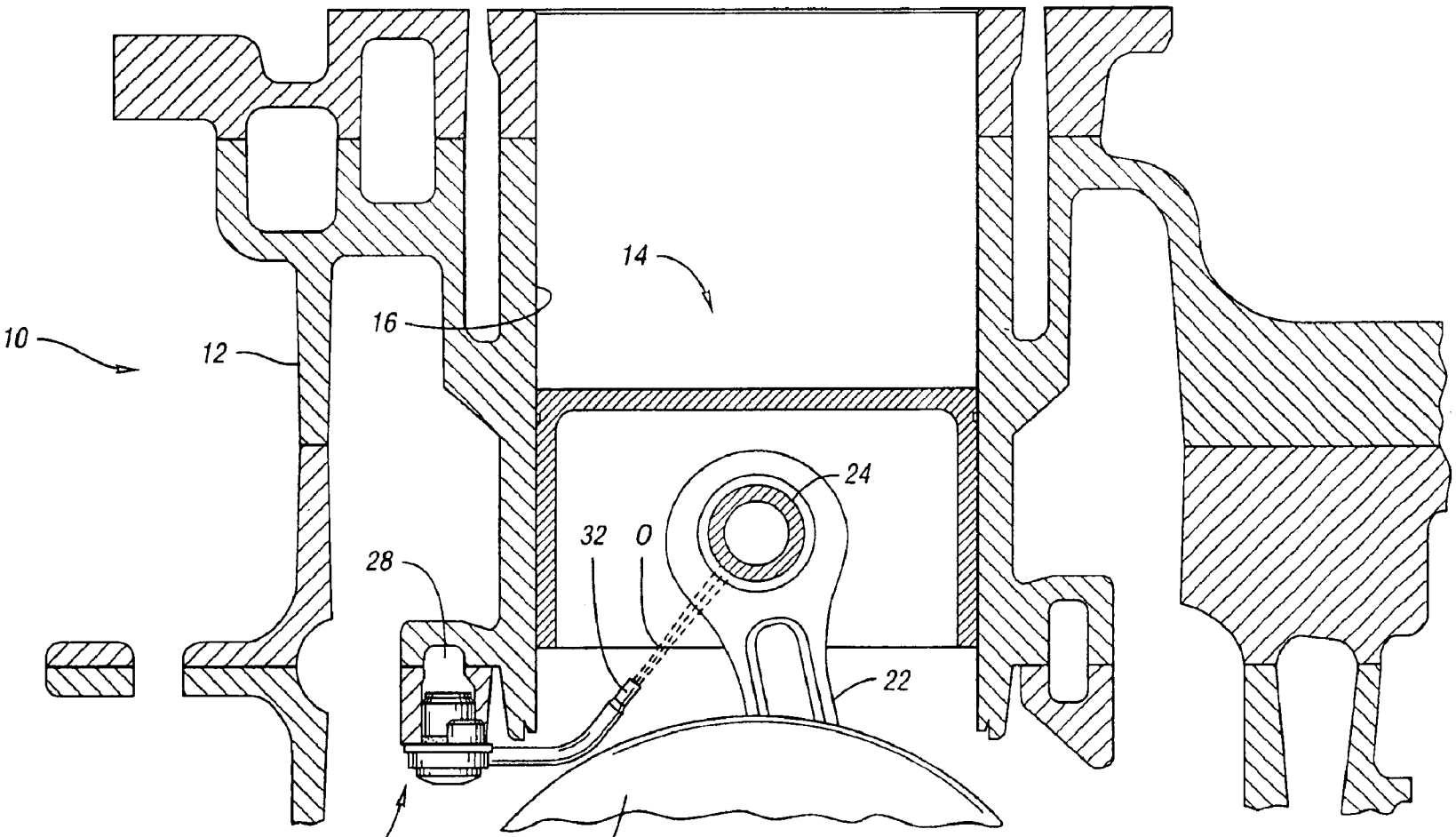
FIG. 2 shows a partial cutaway side view of the engine of FIG. 1 with the piston in midstroke.

FIG. 2 illustrates the engine 10 of FIG. 1 with the piston 14 in a midstroke position at which the oil spray O from the nozzle 32 of the squirter 30 sprays directly onto the wrist pin area for lubricating the wrist pin's 24 joints.

Figure 3:
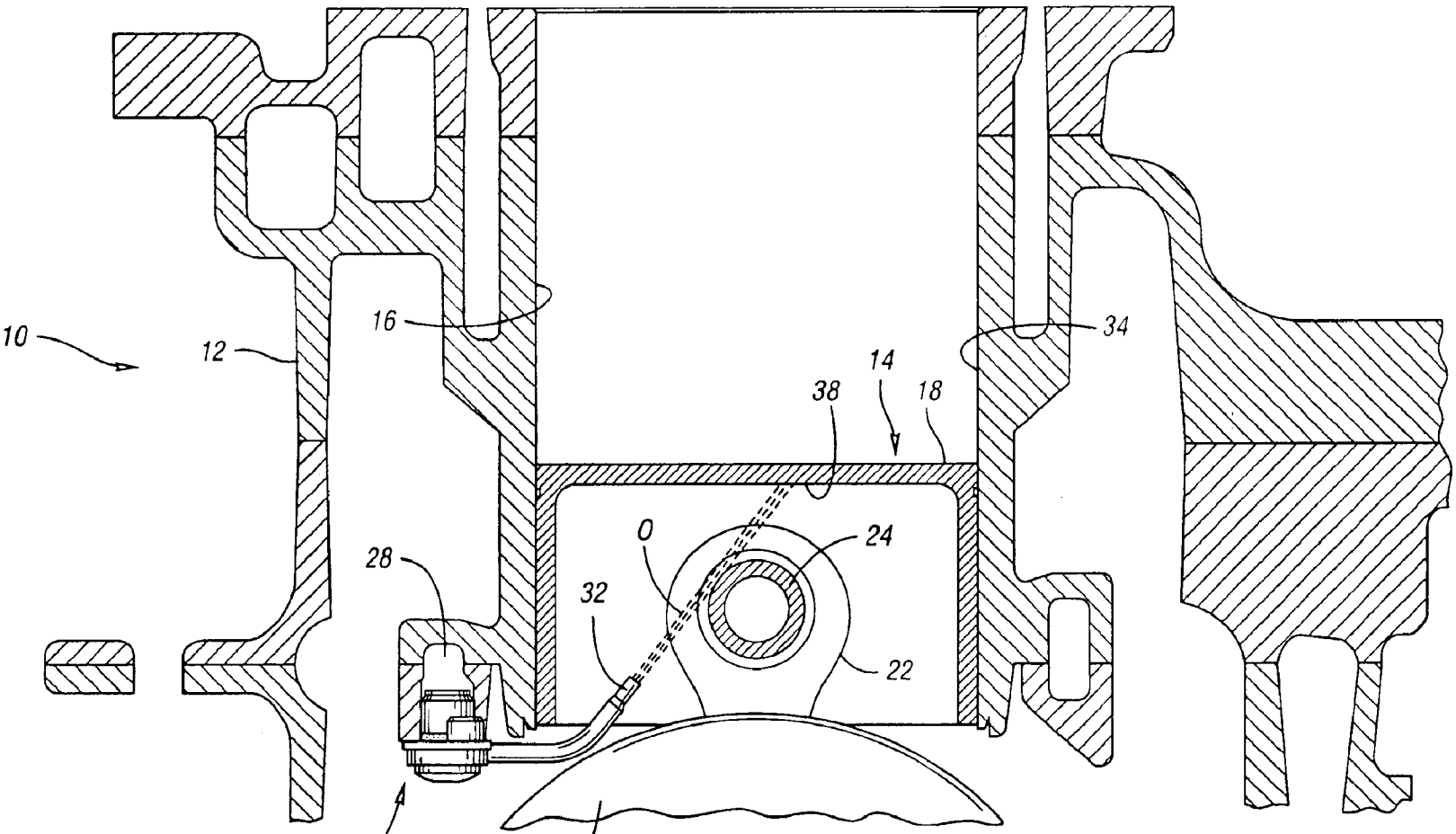
FIG. 3 shows a partial cutaway side view of the engine of FIG. 1 with the piston at bottom dead center.

Turning to FIG. 3, the piston 14 is illustrated in a bottom dead center position in which the sprayed oil O from the nozzle 32 of the squirter 30 is sprayed against the underside 38 of the piston dome 18. By spraying the oil against the underside 38 of the dome 18, piston cooling is achieved. The nozzle 32 is angled so that oil is sprayed into the piston from the underside throughout the majority of the piston stroke, except when the piston is at the top dead center position.

Figure 4:
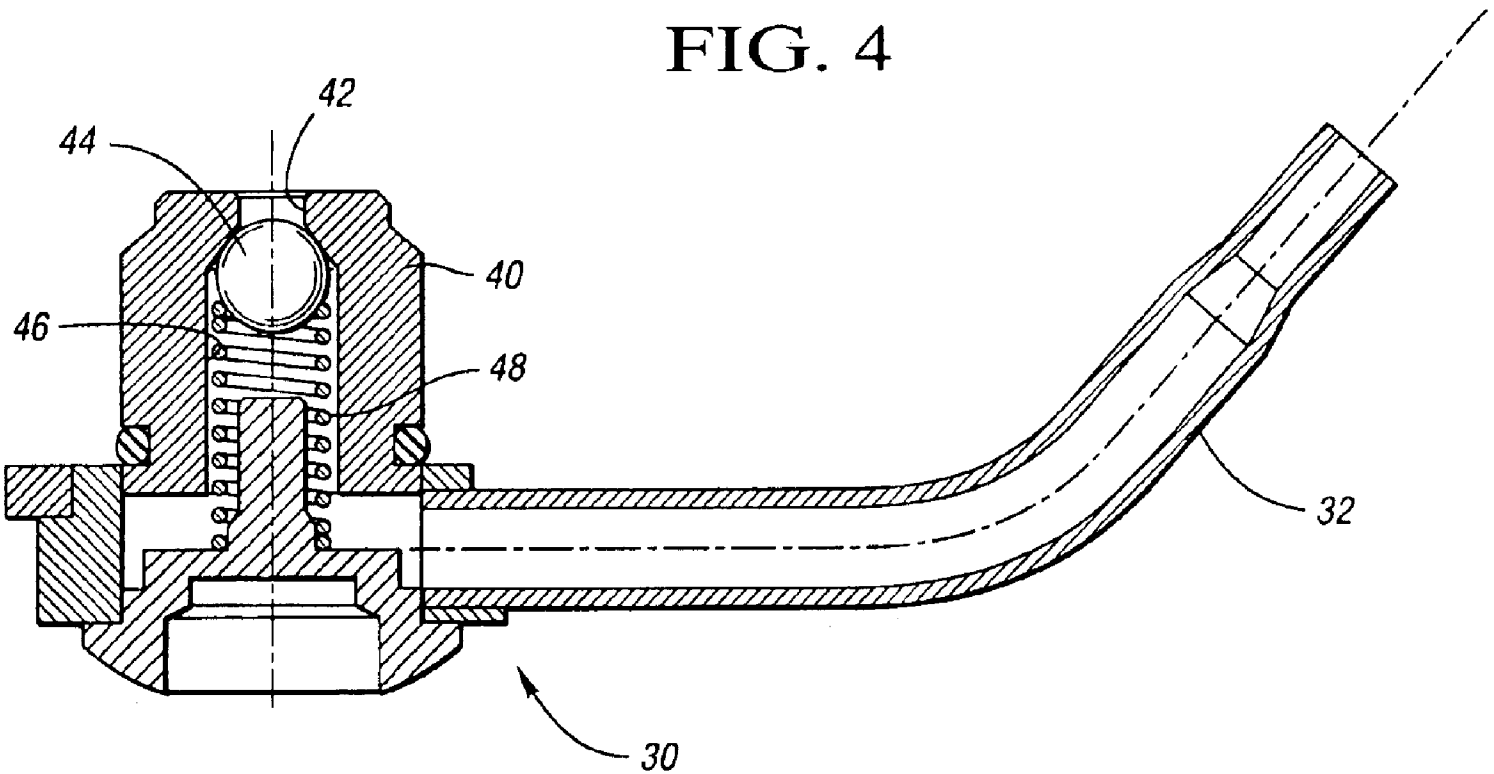
FIG. 4 shows a vertical cross-sectional view of the squirter shown in FIG. 1.

Turning to FIG. 4, a cross-sectional view of the squirter 30 and nozzle 32 is provided. As shown, the squirter 30 includes a body 40 having an opening 42 which receives oil from the rail 28 (shown in FIGS. 1–3). A check ball 44 is positioned in a channel 46 of the body 40, and is spring-biased by the spring 48 so that the squirter only squirts oil when at least a predetermined minimum pressure is available in the engine, such as 25–30 psi, so that needed pressure is not diverted from other areas of the engine when needed. When the oil pressure is significant to move the check ball 44 against the bias of the spring 48, oil flows through the channel 46 and is sprayed out through the nozzle 32 into the cylinder bore.

Angling of the squirters, as described, yielded substantial noise reduction, while providing ample piston cooling. Further, it was importantly discovered that noise reduction was virtually the same irrespective of which thrust side of the piston was lubricated. This is an important discovery since the placement of the squirters is usually most dependent upon the ease of supplying oil to the squirters via a common gallery. For instance, an in-line engine can have the main oil gallery run along either side of the block, depending upon other considerations, and for a V-engine, the gallery may also run just above the apex of the crankcase. Most V-engines use a centrally mounted block squirter head with two nozzles for each cylinder pair. Thus, with a V-engine having the angled squirters of the present invention with two nozzles, one nozzle would squirt to the minor side of the bore, whereas the other nozzle would lube the major side of the opposite bank. Up until this discovery, there was a general mindset that the oil must be sprayed onto the major thrust side of the bore for optimal control of piston noise since most piston slap noise is generated on the major thrust axis. Specifically, most piston noise is generated as the piston leaves the minor side of the bore just before top dead center firing, crosses the clearance gap, and impacts the major side of the bore. If the necessary skirt clearance is void of oil, then the piston impacts the major side with a much higher velocity or with high kinetic energy. Oil within this gap cushions these lateral piston movements. Nonetheless, surprisingly, oil sprayed over to the minor side of the cylinder bore substantially reduces this noise.

Once the piston has moved down from the top dead center position, illustrated in FIG. 1, the oil stream is wholly contained within and is splashed about the piston's interior throughout the remainder of the stroke, therefore essentially the same cooling and pin lubrication is provided as that of traditional centrally aimed block squirters. Actually, the piston spends more time below half stroke than above, which translates into sufficient registry time with the angled squirter's discharge to promote dome cooling and pin lubrication.

The invention also comprehends a loop around nozzle wherein the nozzle would be curved to spray on the same side of the cylinder bore to which the squirter is attached, as opposed to spraying on the opposite wall. Another rendering of the basic concept would be to include dual jets or split nozzles to spray the oil in multiple directions for maximum overall effectiveness. For instance, one nozzle may spray centrally up the piston, while the other is angled as described above.

Accordingly, the invention provides specific targeting of the squirter nozzle to improve lubrication of the reciprocating components which is not possible with prior art on-center block squirters. The result is significant improvement in skirt-to-bore lubrication, which reduces noise. Accordingly, the benefits include significant piston noise reduction upon cold starts, minimum wrist pin noise through improved lubrication of affected joints, reduced wrist pin bushing and bore wear, maintenance of power improvements attained with conventional squirters via reduced piston temperatures, and no degradation of oil consumption.

While the best mode for carrying out the invention has been described in detail, those familiar with the art to which this invention relates will recognize various alternative designs and embodiments for practicing the invention within the scope of the appended claims.

What is claimed is:

1. An internal combustion engine for a vehicle comprising:

an engine block having a piston movable within a cylinder bore, the piston having a piston skirt and a dome;

a connecting rod operatively connecting the piston to a crankshaft; and a squirter connected to the engine block and having a nozzle aimed to spray lubricant against a wall of the cylinder bore slightly below the piston skirt when the piston is at top dead center.

2. The internal combustion engine of claim 1, wherein said nozzle is aimed to spray a continuous stream of the lubricant across the cylinder bore.

3. The internal combustion engine of claim 1, wherein said cylinder bore has a major side and a minor side, and said nozzle is aimed to spray the lubricant on the minor side.

4. The internal combustion engine of claim 1, wherein said nozzle is aimed to spray the lubricant between approximately 3 and 8 millimeters below the piston skirt when the piston is at top dead center.

5. The internal combustion engine of claim 1, wherein said piston is connected to the connecting rod by a wrist pin, and wherein said nozzle is aimed to spray on the wrist pin in the middle portion of each piston stroke.

6. The internal combustion engine of claim 1, wherein said nozzle is aimed to spray the lubricant on an underside of the dome when the piston is at bottom dead center.

7. The internal combustion engine of claim 1, wherein said squirter includes a spring-loaded ball valve to assure that at least a minimum lubricant pressure is available prior to squirting the lubricant.

8. The internal combustion engine of claim 1, wherein the internal combustion engine comprises only one squirter at each said cylinder bore.

9. An internal combustion engine for a vehicle comprising:

an engine block having a piston movable within a cylinder bore between top dead center and bottom dead center positions, the piston having a piston skirt and a dome;

a connecting rod operatively connecting the piston to a crankshaft, wherein said piston is connected to the connecting rod by a wrist pin; and a squirter connected to the engine block and having a nozzle aimed to spray a steady stream of lubricant at an angle across the cylinder bore to spray the lubricant against a wall of the cylinder bore slightly below the piston skirt when the piston is at the top dead center position, to spray the lubricant on the wrist pin when the piston is between the top dead center and bottom dead center positions, and to spray the lubricant on an underside of the dome when the piston is at the bottom dead center position.

10. The internal combustion engine of claim 9, wherein said cylinder bore has a major side and a minor side, and said nozzle is aimed to spray the lubricant on the minor side.

11. The internal combustion engine of claim 9, wherein said nozzle is aimed to spray the lubricant between approximately 3 and 8 millimeters below the piston skirt when the piston is at top dead center.

12. The internal combustion engine of claim 9, wherein said squirter includes a spring-loaded ball valve to assure that at least a minimum lubricant pressure is available prior to squirting the lubricant.

13. The internal combustion engine of claim 9, wherein the internal combustion engine comprises only one squirter at each said cylinder bore.

14. A method of lubricating a piston reciprocating between top dead center and bottom dead center positions within a cylinder bore of an engine block, wherein the piston has a dome and a skirt, the method comprising:

spraying lubricant across the cylinder bore against a wall of the cylinder bore slightly below the skirt of the piston when the piston is at the top dead center position;

spraying lubricant onto a wrist pin connecting the piston with a connecting rod when the piston is between the top dead center and bottom dead center positions; and spraying lubricant onto an underside of the dome when the piston is at the bottom dead center position.

15. The method of claim 14, wherein said spraying steps are performed by spraying a continuous stream of lubricant.

16. The method of claim 15, wherein said continuous stream of lubricant is sprayed from only a single squirter connected to the engine block for each said cylinder bore.

17. The method of claim 14, wherein the cylinder bore has a major side and a minor side, and said spraying is performed by a squirter having a nozzle aimed to spray the lubricant across the cylinder bore toward the minor side.

18. The method of claim 14, wherein said lubricant is sprayed between approximately 3 and 8 millimeters below the piston skirt when the piston is at top dead center.

19. The method of claim 14, further comprising, prior to spraying, assuring that at least a minimum lubricant pressure is available in the engine by the use of a spring loaded ball valve.

* * * * *